United States Patent [19]

Nakamura

[11] 4,061,056

[45] Dec. 6, 1977

[54] METHOD OF MAKING OUTER BLADES FOR ELECTRIC SHAVERS

[75] Inventor: Yoshimitsu Nakamura, Settsu, Japan

[73] Assignee: Matsushita Electric Works, Ltd., Osaka, Japan

[21] Appl. No.: 671,581

[22] Filed: Mar. 29, 1976

[30] Foreign Application Priority Data

Apr. 3, 1975 Japan ..... 50-40859

[51] Int. Cl.[2] ..... B21K 11/00

[52] U.S. Cl. ..... 76/104 R

[58] Field of Search ..... 30/346.5, 346.61; 76/101 R, 101 SM, 104 R, DIG. 8

[56] References Cited

U.S. PATENT DOCUMENTS

| | | | |
|---|---|---|---|
| 2,168,406 | 8/1939 | Harris | 76/104 R |
| 2,223,768 | 12/1940 | Martin | 76/104 R |
| 3,216,286 | 11/1965 | Heyek | 76/101 SM |
| 3,881,373 | 5/1975 | Nakamura et al. | 76/104 R |

*Primary Examiner*—Harold D. Whitehead
*Assistant Examiner*—James G. Smith
*Attorney, Agent, or Firm*—Leydig, Voit, Osann, Mayer & Holt, Ltd.

[57] ABSTRACT

A method of making outer blades for electric shavers wherein a metal sheet in which many hair inlet holes are made by punching or coining process is subjected to grinding process performed on the side at which the blade is to engage inner blade of the shaver and then to pressing process with a soft ram pressed against a rigid body on which the sheet is placed, so that any grinding fins remaining on peripheral edges of the respective holes will be thereby removed.

9 Claims, 22 Drawing Figures

METHOD OF MAKING OUTER BLADES FOR ELECTRIC SHAVERS

This invention relates to methods of making outer blades for electric shavers.

In making outer blades having a number of small hair inlet holes for electric shavers, conventionally, the hair inlet holes are made by punching a material metal sheet and any punching fins produced on opening edges of the respective hair inlet holes at the time of such punching are removed by being ground off along the material metal sheet or, alternatively, a concavo-convex pattern of desired hair inlet holes is initially formed by means of a coining work in the material metal sheet and concavo or convex parts corresponding to the holes of such sheet are then ground off so as to form the hair inlet holes. In either method, the grinding fins which will remain on the opening edges of the hair inlet holes must be removed. Such fins have been conventionally removed by etching, electrolytic polishing or lapping process.

In FIG. 1, there is shown an example of an outer blade for electric shavers according to the present invention, in which many hair inlet holes 2 of a desired shape are arranged in any desired pattern in a thin metal sheet of a thickness, for example, 0.01 to 0.3 mm. The surface 3 is to be the side with which the blade is brought into contact with user's skin while the other surface 4 is to be the side with which the blade engages an associated inner blade of the shaver (not shown).

A typical conventional method of making the outer blades utilizing an etching process shall be explained with reference to FIGS. 2A through 2F which showing sequential states of the material metal sheet in sections during the method. FIG. 2A is of a state in which concavo-convexs 12 of a pattern for making desired hair inlet holes are formed in the metal sheet 11 by a coining work. FIG. 2B is of a state in which the metal sheet 11 of FIG. 2A is provided with a resist-coating 13 over entire surfaces 14 and 15 after heat-treated for quenching and annealing. The surface 14 is to be the outer surface of the blade with which the same is brought into contact with the user's skin, while the other surface 15 is to be the inner surface with which the blade engages the inner blade for performing the shaving. In next state of FIG. 2C, the convex parts are roughly ground off on the side of the surface 15 to form hair inlet holes 16. In this case, grinding fins 17 of the material metal of the sheet 11 are caused to be made substantially in the parts of the hair inlet holes 16. Such grinding fins 17 are removed by etching with an etching solution, and a state as shown in FIG. 2D is reached. Then the resist coatings 13 are removed, in which state as shown in FIG. 2E bared metal out of the coating 13 around the holes 16 are also etched off so that edges of the holes 16 which are to act as blade surface of the outer blade for hair cuttng with the inner blade will be roughened and inclined inward the holes as denoted by $d_1$ and, therefore, a further finish-grinding work will be required for flattening the blade surface to reach a state as shown in FIG. 2F, but in this state grinding-fins $f_1$ are again produced so as to impair hair cutting effect of the blade.

According to this conventional method, therefore, there are involved such defects that (i) grinding fins will still remain after the finish-grinding, (ii) as the etching process is adopted, the manufacture of the outer blade will be difficult in dimension control and low in working precision, and (iii) a waste solution must be produced in the etching step, disposing costs of which for antipollution purpose will become high. The present invention has been suggested to remove such defects of the conventional methods.

The present invention successfully removes the defects by providing a new method comprising steps of subjecting a metal sheet to a grinding work to form many hair inlet holes, and removing any grinding fins remaining on the peripheral edges of the hair inlet holes by pressing a soft ram against the ground metal sheet on the side to engage the inner blade.

A primary object of the present invention is, therefore, to provide a method of making outer blades for electric shavers requiring only a remarkably reduced number of steps of making holes to obtain hair inlet holes as compared with any conventional methods which involving such a step as electrolytic polishing, etching or lapping.

Another object of the present invention is to provide a method of making outer blades for electric shavers wherein no etching solution and thus no waste-solution disposing costs are required.

A further object of the present invention is to provide a method of making outer blades for electric shavers which is high in the working precision.

Another object of the present invention is to provide a method of manufacturing outer blades for electric shavers which is suitable for performing the manufacture in a continuous manner easy to be automated.

Other objects and advantages of the present invention shall be made clear as the following disclosures advance as detailed with reference to accompanying drawings, in which.

Figure 1:
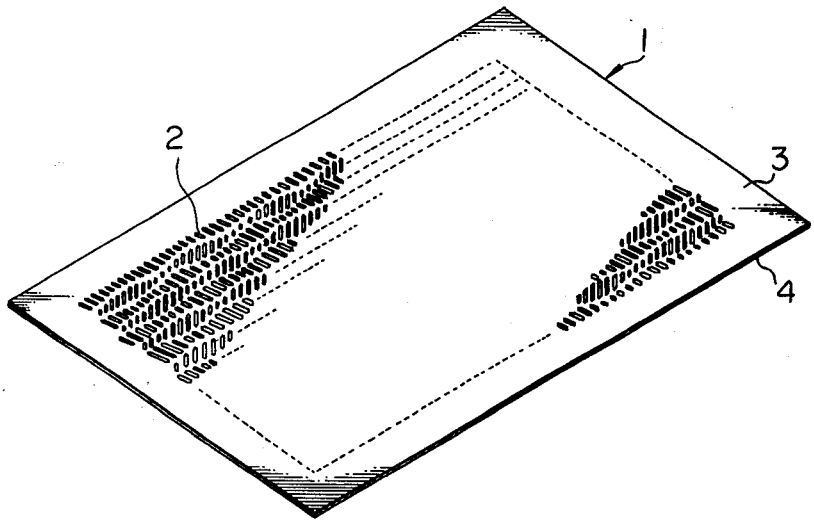
FIG. 1 is a perspective view of an outer blade for electric shavers to which the method of the present invention relates.
Figure 2A:
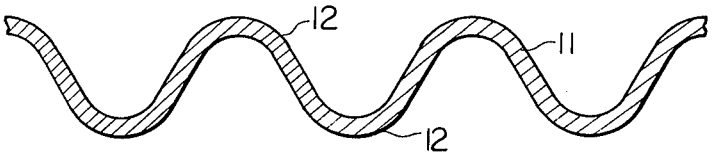
FIGS. 2A through 2F show schematically respective sequences of a conventional method of making the outer blade in fragmentary sections as magnified of the blade.
Figure 2B:
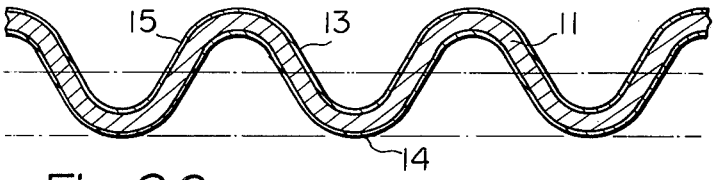
Figure 2C:
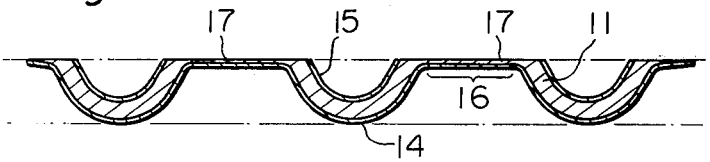
Figure 2D:
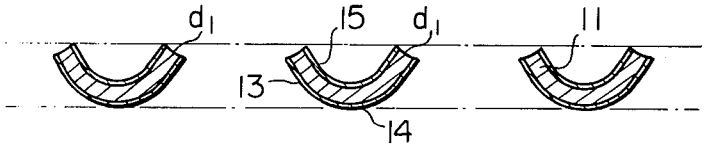
Figure 2E:
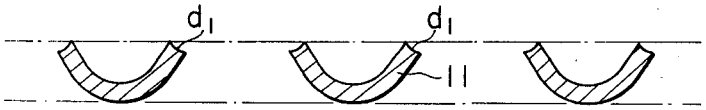
Figure 2F:
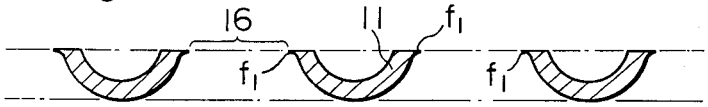
Figure 3A:
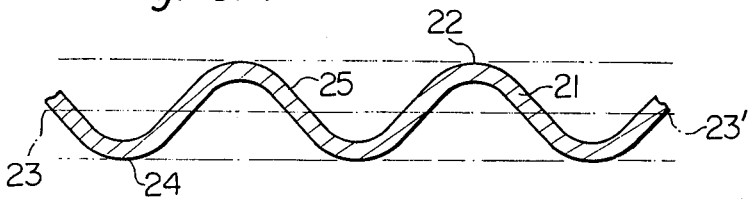
FIGS. 3A to 3D shows schematically sequences of an embodiment of the method according to the present invention in fragmentary sections as magnified of the blade.
Figure 3B:
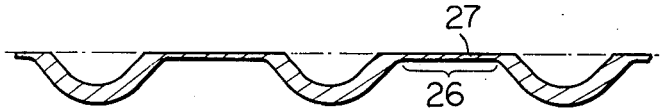
Figure 3C:
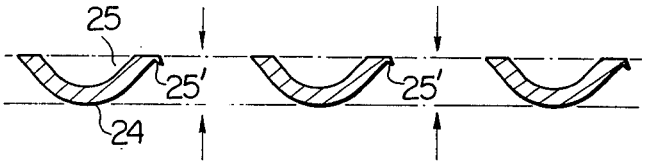
Figure 3D:
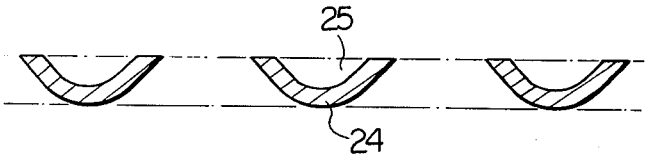

Referring now to FIGS. 3A to 3D showing sequences of steps of making the outer blade in an embodiment of the present invention, a metal sheet 21 is first subjected to a coining operation to form any desired pattern of concavo-convexes 22 or corrugations in the sheet as shown in FIG. 3A, in which state the metal sheet 21 is then heat-treated to be quenched and buffed to be cleaned on the surface. In FIG. 3A, the side 24 of the sheet is to be the outer surface of the blade with which the blade is brought into contact with the user's skin in use of the shaver, while the other side 25 is to be the inner surface at which the blade engages the inner blade of the shaver for shaving hairs. Concavo parts of the sheet 21 shown in FIG. 3A above a chain line 23 – 23' are then ground off so that the sectional view of the sheet 21 will reach a state of FIG. 3B. After this grinding operation, hair inlet holes 26 are formed but, in this case, grinding fins 27 of material metal of the sheet 21 are produced to remain substantially closing the holes 26. In order to remove such fins, a dieing-out operation with a soft ram is performed. For example, a rigid plate of a metal or the like is placed on the side 24 and a soft ram plate of rubber or the like is pressed against the side 25 under a pressure sufficient to remove the grinding fins with the ram. FIG. 3C shows a state that the dieing-out operation is finished. In this state, small fins 25' bent toward the side 24 to be in contact with the skin will partly remain on the edges of the holes. In order to remove these still remaining grinding fins, a jet definning operation is performed by jetting water under high pressure, onto the side 24 and the fins 25' of which connection to the sheet 21 is already partially cracked will be easily removed. FIG. 3D shows a state in which the jet definning operation is finished. Then an annealing operation is performed to complete the outer blade.

Figure 4A:
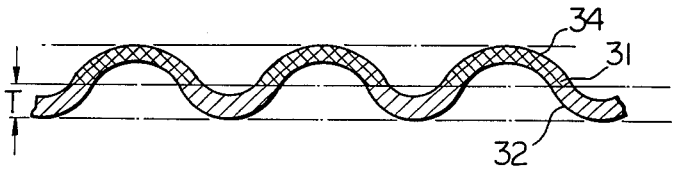
FIGS. 4A to 4C are detailed explanatory views in magnified sections of a dieing-out operation with a soft ram performed in the method according to the present invention.
Figure 4B:
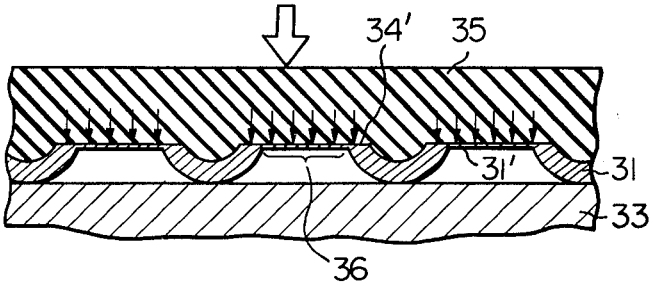
Figure 4C:
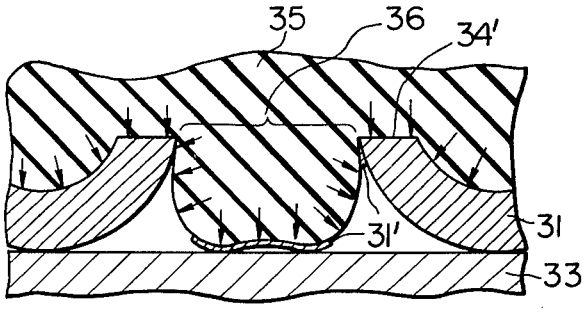

Details of the dieing-out operation with soft ram shall be explained with reference to FIGS. 4A to 4C. The metal sheet 31 is subjected to, as explained already, the coining operation to form the desired pattern of concavo-convexes and then to the grinding operation on the side of the surface 34 so that double-way hatched parts in FIG. 4A will be ground off and the entire thickness of the coining processed sheet 31 will be as shown by T in the drawing. Then the sheet 31 is placed on a flat and rigid body 33 to engage it on the convex surface side 32 of the sheet and a soft ram 35 of rubber, plastics or the like is butted against the other surface side 34 subjected to the grinding, as seen in FIG. 4B. When said soft ram 35 is pressed evenly toward the rigid body 33, the ram 35 will be protruded on the side of the rigid body 33 through hair inlet holes 36 as shown in FIG. 4C. In such case, the grinding fins 31' will be shorn to be punched or will be bent so as to be removed.

The above described operation shall be further detailed in the following. A material stainless steel sheet of a trade name SUS420 of a thickness of 0.04 mm. is coining processed and shaped to be in any required concavo-convex form, heat-treated to be of a Vicker's hardness of 570 to 600 and then grinding processed to be of a thickness of 70 microns. This ground material sheet is placed on the flat rigid body of a quenched die steel and a urethane rubber of a rubber hardness of JIS (Japanese Industrial Standards) A90 to 99° is placed over the sheet and pressed against the sheet with 6 to 7 kg./mm$^2$. The grinding fins have been successfully removed by this operation.

Figure 5A:
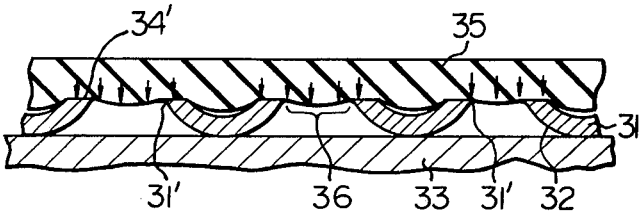
FIGS. 5A and 5B and FIG. 6 are similar explanatory views of the dieing-out operation performed in respective other embodiments of the present invention.
Figure 5B:
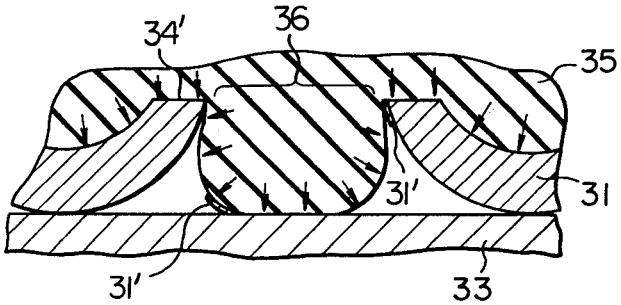

In FIGS. 5A and 5B, there is shown an embodiment of the dieing-out operation utilized in a case wherein hair inlet holes are formed by a punching operation made to a metal sheet, the metal sheet is then subjected to the grinding process in the parts corresponding to the hair inlet holes so as to be of a predetermined thickness, and any grinding fins produced during the grinding operation in the hair inlet holes are to be removed. A metal sheet 31 heat-treated and then ground is placed on the rigid metal body 33 with the surface 32 of the side to be the outer surface of the blade engaged with the body 33 and the soft ram 35 of rubber or plastics is placed over the other surface 34 subjected to the grinding. When this soft ram 35 is pressed against the metal sheet 31, the ram will be protruded on the rigid body side through hair inlet holes 36 of the metal sheet 31 as seen in FIG. 5B, thereby the grinding fins 31' will be shorn and punched off or will be bent along the side 32.

Figure 6:
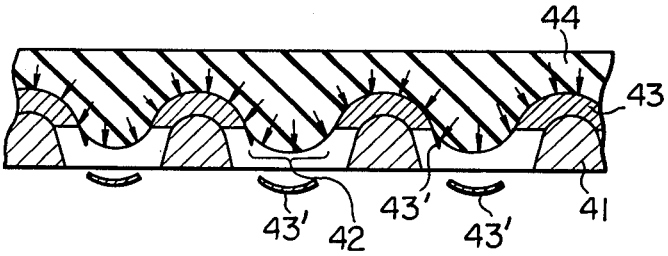

In FIG. 6 another embodiment of the present invention is shown, wherein a convex die 41 is used in punching or coining operation of the metal sheet denoted herein as 43 is used as the rigid body in removing the grinding fins. In this case, the metal sheet 43 after punching or coining and grinding processed to form the hair inlet holes 42 is mounted again on the convex die 41 so as to engage it with concave side of the sheet and the soft ram 44 placed over convex side of the metal sheet 43 is pressed against the sheet to remove the grinding fins 43'.

Figure 7A:
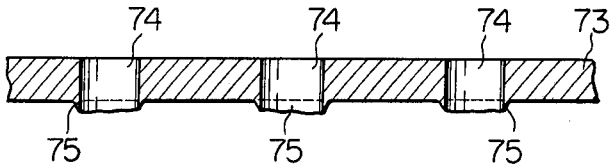
FIGS. 7A to 7C are fragmentary magnified sections of the outer blade showing schematically respective sequences of a further embodiment of the present invention.
Figure 7B:
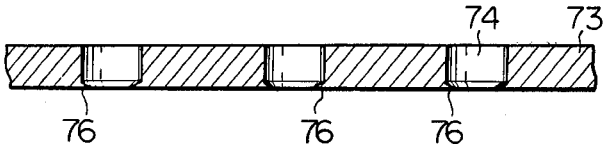
Figure 7C:
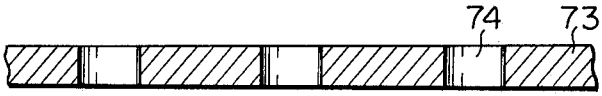

The method of the present invention can be applied also to a manufacture of flat type outer blades for electric shavers as shown in FIGS. 7A to 7C which requiring no coining operation for concavo-convex shaping of the metal sheet. That is, many hair inlet holes 74 are made by punching a flat metal sheet 73, in which state the sheet 73 as shown in FIG. 7A has punching fins 75 produced extending in axial direction of the respective holes 74. These punching fins 75 are then ground off but, in this state, grinding fins 76 remain in edges of the holes as shown in FIG. 7B. Thus the dieing-out operation with the soft ram employed in the present invention is then applied to the sheet 73 in the state of FIG. 7B so that the grinding fins 76 will be removed.

Figure 8:
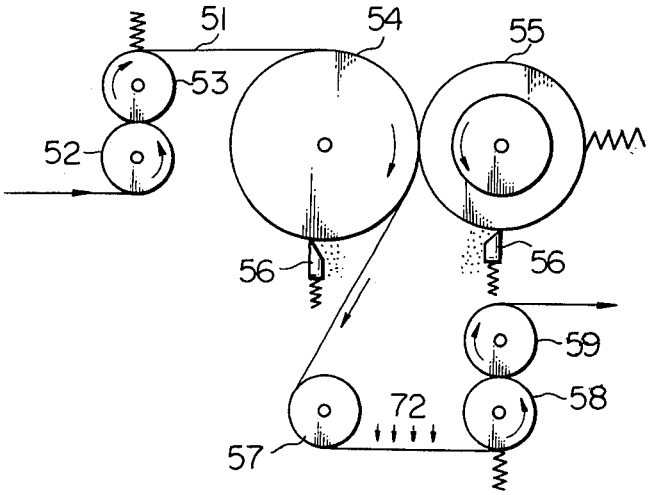
FIGS. 8 and 9 are schematic views respectively showing other embodiments in which the present invention is applied to automated continuous operations.

A further embodiment of the present invention adapted to an automated line operation performing the respective steps of the method in continuous manner shall be explained next with reference to FIG. 8, in which case, in particular, a heat-treated steel sheet in long hoop shape is continuously fed to the line of sequentially punching or coining and grinding the hoop for making the hair inlet holes and removing any punching or grinding fins remaining in the hair inlet holes. More specifically, a steel hoop 51 in which hair inlet holes are already formed is passed between tension rolls 52 and 53 and is then passed between a metal roll 54 and a soft ram roll 55 urged under a pressure to the roll 54. In this case, the hoop is so arranged that the side to be the outer surface of the blade for contacting the user's skin is brought into contact with the metal roll 54 so that any punching or grinding fins will be urged by the ram rool 55 to be removed to the said side. Thus removed scraps of the punching or grinding fins deposited on either roll will be removed from the rolls by scrapers 56 resiliently contacting edgewise with the roll surfaces. The hoop 51 is then subjected to water jets 72 between the rolls 57 and 58 so as to have any remaining fine fins removed and is taken out through a tension roll 59.

Figure 9:
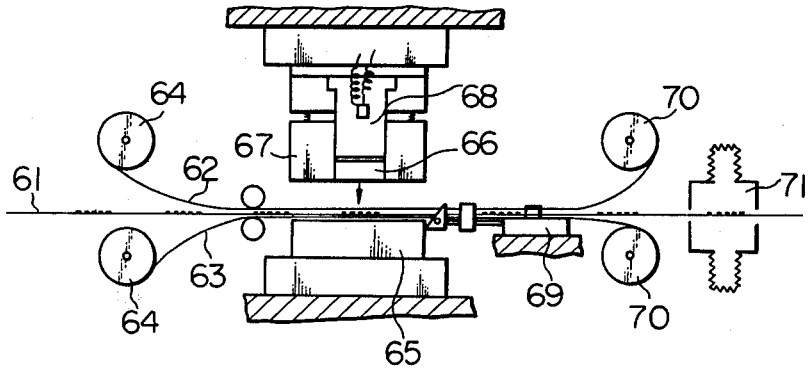

In FIG. 9, there is shown a further embodiment of the present invention applied to a similar sequential operation, according to which the grinding fins can be specifically efficiently removed from the hoop of outer blade sheet. In the drawing, plastic film 62 and 63 are payed out of respective pay-out reels 64 to be placed on both sides of a hooped outer blade sheet 61 already subjected to the coining and grinding operations and the sheet 61 thus sandwitched between the films 62 and 63 is moved onto a metal die 65, on which position a soft ram 66 is pressed against the sheet by a punch 68 with retainers 67 as a guide, grinding fins will be removed and will remain as held between the plastic films 62 and 63. The grinding fins thus enclosed with the plastic films will be carried out by an air feeder 69 when the plastic films 62 and 63 are wound up on respective winding reels. 70. The grinding fins still deposited or remained on the outer blade sheet 61 will be blown away and removed by water jets 71. According to this embodiment, grinding fins can be efficiently removed. Polyethylene or polypropylene films of a thickness less than 20 microns are used for the plastic films. A polyester film may be also used for the lower film 63.

While, in the foregoing descriptions of the respective embodiments of the method according to the present invention, the grinding fin removing operation has been referred to in the case of the flat material sheet for the outer blade of electric shavers which is specifically used with the shavers of the type in which the flat outer blade is mounted to a shaver as semi-cylindrically curved, it will be readily appreciated that the particular operation as well as the method of the present invention can be properly applied to outer blades having curved surfaces.

What is claimed is:

1. The method of making an outer blade for an electric shaver comprising the steps of forming a thin metal plate with a two-dimensional pattern of openings separated by lands so that each land is of arcuate section producing a smooth lower side having upwardly presented edges of metal extending in a direction away from the smooth side, grinding the upwardly presented edges to the same level to sharpen them accompanied by formation of fins which extend laterally from the lands into the adjacent openings, and then pressing the blade between a smooth layer of hard material on one side and a layer of resilient material on the other, the resilient material being on the finned side and the hard material being on the smooth side, so that the surface of the resilient material bulges locally through the individual openings to break off the fins with the result that each opening is bounded by clearly defined sharpened edges.

2. The method according to claim 1 in which the smooth side is subsequently subjected to a high pressure jet of fluid for removal of the residual and broken-off fins.

3. The method according to claim 1 wherein the layers of hard material and resilient material are formed on respective rollers opposed to one another under pressure.

4. The method according to claim 1 wherein the plate is covered on both sides with plastic films prior to engagement by the layers of hard material and resilient material.

5. The method according to claim 1 in which a layer of urethane rubber is used as the resilient material.

6. The method according to claim 4 wherein the plastic films are formed of polypropylene.

7. The method according to claim 4 in which the plastic films are of polyethylene.

8. The method according to claim 1 in which the opening-forming step comprises a punching process.

9. The method according to claim 1 in which the opening-forming step comprises a coining process in which corrugations are extended in opposite directions from the plate followed by a grinding process in which the corrugations extending in one direction are removed.

* * * * *